US009386831B1

(12) United States Patent
Raihala

(10) Patent No.: US 9,386,831 B1
(45) Date of Patent: Jul. 12, 2016

(54) ICE CLEAT ACCESSORY FOR A WALKING AID RETRIEVING TIP

(71) Applicant: Kenneth Herman Raihala, Superior, WI (US)

(72) Inventor: Kenneth Herman Raihala, Superior, WI (US)

( * ) Notice: Subject to any disclaimer, the term of this patent is extended or adjusted under 35 U.S.C. 154(b) by 0 days.

(21) Appl. No.: 14/544,675

(22) Filed: Feb. 4, 2015

(51) Int. Cl.
*A45B 9/04* (2006.01)

(52) U.S. Cl.
CPC ..... *A45B 9/04* (2013.01)

(58) Field of Classification Search
CPC ..... A61H 3/0288; A45B 9/04
USPC ..... 135/77, 80
See application file for complete search history.

(56) References Cited

U.S. PATENT DOCUMENTS

| | | | | | |
|---|---|---|---|---|---|
| 970,497 | A * | 9/1910 | Harding | A61H 3/0288 | 135/70 |
| 1,031,247 | A * | 7/1912 | Conrad | A61H 3/0288 | 135/80 |
| 1,305,867 | A * | 6/1919 | Atlas | A45B 9/04 | 135/78 |
| 1,504,902 | A * | 8/1924 | Rosenhein, Jr. | A61H 3/0288 | 135/78 |
| 2,230,406 | A * | 2/1941 | Johnson | A61H 3/0288 | 135/77 |
| 2,492,916 | A * | 12/1949 | Chute | A61H 3/0288 | 135/80 |
| 2,606,568 | A * | 8/1952 | Walcot | A61H 3/0288 | 135/80 |
| 2,631,597 | A * | 3/1953 | Phinney | A61H 3/0288 | 135/78 |
| 2,703,094 | A * | 3/1955 | Speck | A61H 3/0288 | 135/80 |
| 3,177,884 | A * | 4/1965 | Thro | A45B 9/04 | 135/77 |
| 3,949,773 | A * | 4/1976 | Marescalco | A45B 9/04 | 135/78 |
| 4,299,246 | A | 11/1981 | Marsh | | |
| 4,411,284 | A | 10/1983 | Opiyz | | |
| 4,434,808 | A | 3/1984 | Burak | | |
| 4,964,430 | A | 10/1990 | Janis | | |
| 5,069,102 | A * | 12/1991 | Wolf | G10D 3/003 | 248/188.9 |
| 5,377,710 | A * | 1/1995 | Laser | A61H 3/0288 | 135/66 |
| 5,640,985 | A | 6/1997 | Snyder et al. | | |
| 8,555,907 | B2 * | 10/2013 | Kutz | A61H 3/0288 | 135/65 |
| 8,863,764 | B2 * | 10/2014 | Zarins | A45B 9/04 | 135/77 |

FOREIGN PATENT DOCUMENTS

| | | | | |
|---|---|---|---|---|
| DE | 102007054270 A1 * | 5/2009 | | A45B 9/00 |
| WO | WO 2008094103 A1 * | 8/2008 | | A45B 9/04 |

* cited by examiner

*Primary Examiner* — Noah Chandler Hawk

(57) ABSTRACT

An ice cleat designed to fit slidably onto the finger of a retrieving tip for a cane, crutch, walking stick or the like, without use of tools to provide the walking aid user with anti-skid protection on icy or snow covered surfaces.

1 Claim, 1 Drawing Sheet

ICE CLEAT ACCESSORY FOR A WALKING AID RETRIEVING TIP

CROSS REFERENCE TO RELATED APPLICATION

This application claims the benefit of Provisional Patent Application No. 61/965,730 Filed Feb. 7, 2014 by this applicant.

FEDERALLY SPONSORED RESEARCH not applicable

SEQUENCE LISTING OR PROGRAM not applicable

BACKGROUND

Prior Art

The following is a tabulation of some prior art that presently appears relevant regarding retrieving tip ice cleats for canes, crutches, walking sticks or the like.

| U.S. PATENTS | | |
|---|---|---|
| PAT. NO. | ISSUE DATE | PATENTEE |
| 4,299,246 | Nov. 10, 1981 | John W. K. Marsh |
| 4,411,284 | Oct. 25, 1983 | Eric J. Opitz |
| 4,434,808 | Mar. 6, 1984 | Mark G. Burak |
| 4,964,430 | Oct. 23, 1990 | William F. Janis |
| 5,377,710 | Jan. 3, 1995 | Jay M. Laser |
| 5,640,985 | Jun. 24, 1997 | Kent Snyder et.al. |

PRIOR ART

The use of canes, crutches, walking sticks and the like among the elderly or others afflicted by illness or injury is well known. A recent patent search has disclosed a number of devices useful with walking aids to retrieve objects from a walking surface and or to provide an anti-slip device at the walking aid tip. However, none of the searched patents incorporated an anti-slip ice cleat designed specifically for a retrieving tip as shown in Prior Publication Data U.S. 2014/0360544 published Dec. 11, 2014.

One prior art device is shown in U.S. Pat. No. 4,299,246 by Marsh. This device describes a cane with a retrieving device contained within the hollow shaft of the cane. This is a retrieving cane, but does not fit the description of a retrieving tip. It does not contain any information on the availability of an ice cleat attachment to fit that device or to attach to a retrieving tip finger.

Another prior art shown in U.S. Pat. No. 4,411,284 by Opitz consists of a cane without a retrieving device. It lacks any information about how this ice cleat attachment could possibly fit onto a retrieving tip finger without considerable alterations and not interfere with the operation of a retrieving tip.

Another prior art device shown in U.S. Pat. No. 4,434,808 by Burak describes a cane with trigger actuated non-skid pins located at the tip of a cane. This device would not be suitable as an attachment onto a retrieving tip. Burak does not teach how that mechanism could possibly be self-contained on a retrieving tip.

Still other prior art shown in U.S. Pat. No. 4,964,430 by Janis describes an ice gripper attachment to a walking aid secured to the tip by mechanical means. This attachment as installed onto a retrieving tip would inhibit the retrieving function of the tip unless removed with the use of tools. Additionally, the asymmetry of a retrieving tip may prevent use of this device on walking aids.

Prior art shown in U.S. Pat. No. 5,377,710 by Laser displays and ice tip cleat that fits over a crutch tip and held by elastic bands or metal straps attached to the crutch shaft by fasteners. This cleat is not designed to attach to a retrieving tip since the bands or straps are secured to the crutch shaft. The band securing bracket would not allow the user of a retrieving tip access to the finger mechanism unless the band was removed from the crutch shaft. This does not fulfill the intended requirement of an ice cleat for a retrieving tip.

Another prior art shown in U.S. Pat. No. 5,640,985 by Snyder shows a retrieving cane with finger but does not reveal availability of an ice cleat or grabber to fit onto the finger of a retrieving tip.

A market search reveals a "5 cleat ice pick for canes and crutches" available at most hospital supply stores. This device fastens by mechanical means onto the shaft of a cane or crutch above the existing tip. This device contains an ice pick attached to a moveable arm that can swing down to place the ice pick against the contacting surface of the tip. This device if used on a retrieving tip would limit access to a retrieving tip knob and not fulfill the requirement for an ice cleat to fit onto a retrieving tip.

SUMMARY

A search of U.S. Patents by this applicant has not disclosed an ice cleat specifically designed to fit onto the finger of a retrieving tip for a cane, crutch, walking stick or the like.

Advantages

The ice cleat designed to fit onto the finger of a retrieving tip provides the tip with an additional use for icy surfaces, aside from its original design function of retrieving items from a walking surface and providing an anti-slip contacting surface. The ice cleat is easily installed without use of tools, does not use brackets, levers or cables or contribute significantly to the walking aid tip weight. The ice cleat does not present a potentially hazardous condition to the user or others.

FIGURES

DRAWING

Reference Numbers

10. Body
12. Disk

14. Teeth
16. Tube
18. Knob
20. Finger
22. Finger Recess
26. Socket

DETAILED DESCRIPTION

First Embodiment

Figure 1:
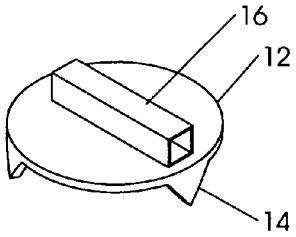
FIG. 1 is an isometric view of an assembled ice cleat for a retrieving tip.
Figure 2:
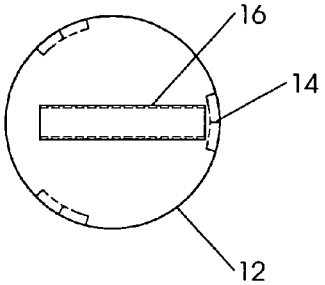
FIG. 2 is a top view of an assembled ice cleat.
Figure 3:
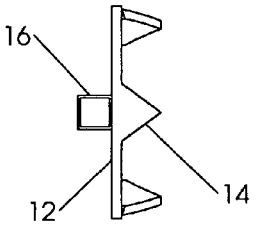
FIG. 3 is an end view of an assembled ice cleat.
Figure 5:
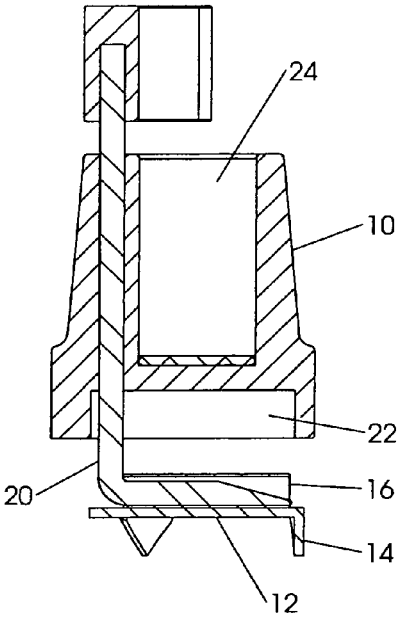
FIG. 5 is a cross-sectional elevation view of an assembled retrieving tip with ice cleat installed onto finger.
Figure 6:
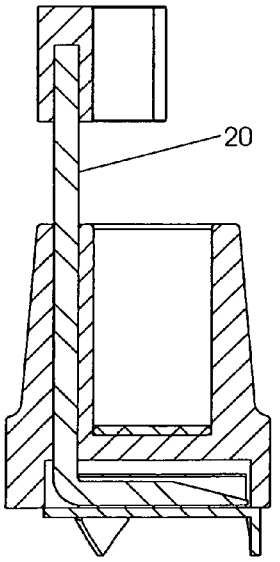
FIG. 6 is a cross-sectional elevation view of an assembled retrieving tip with ice cleat installed onto finger.

Referring to FIG. 1 is an illustration of an isometric view of an assembled ice cleat designed to fit slidably onto a retrieving tip finger 20 as shown in "FIG. 5. The ice cleat consists of a metal disk 12 preferably of a non-corrosive material such as stainless steel, galvanized steel, Bronze, tempered aluminum or materials known to those familiar with the art. Disk 12 is shown with its diameter proximate the diameter of the body 10 segment at the tip contacting surface entered on the socket 26 axis. Disk 12 may be die cut of metal and formed into a single piece to include a predetermined number of teeth 14 of predetermined length, in a predetermined arrangement. Disk 12 may also be shaped to fit the asymmetrical body 10 at the contacting surface of the retrieving tip.

Tube 16 may be metal, preferably of a non-corrosive material such as stainless steel, brass or as known to those familiar in the art. Tube 16 shall be of dimension and shape to fit slidably onto the retrieving tip finger 20 of the same dimension and shape, and with length to fit within the finger recess 22. Tube 16 may be attached to disk 12 by welding, soldering, cementing or as known to those familiar in the arts. Tube 16 may also be formed as a hat section and attached by spot welding or other previously mentioned means to disk 12. Ice cleat materials shall be of thickness, hardness and strength to withstand forces anticipated in the normal use of a walking aid.

Other embodiments may include a metal disk 12 with welded, brazed, cast or soldered teeth 14 of a predetermined number, length and arrangement. Disk 12 may also be formed with contained teeth 14 and tube 16 of plastic, resin, or other like materials by injection molding, casting or other means known by those familiar in the art.

Figure 7:
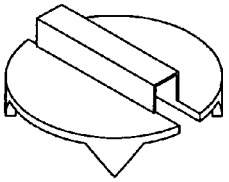
FIG. 7 is an isometric view of an ice cleat formed of a single piece of metal
Figure 4:
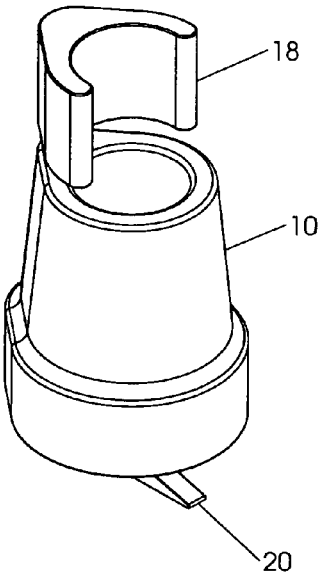
FIG. 4 is an isometric view of an assembled retrieving tip.

Still another embodiment includes an ice cleat formed of a single piece of metal to include disk 12, tube 16 and teeth 14 by die cutting and forming into a shape similar to FIG. 7. The ice cleat in this embodiment would allow the cleat to be placed onto the retrieving tip finger 20 rather than slide on.

Operation

The ice cleat is designed specifically for use with a retrieving tip such as (Publication No. U.S. 2014/0360544). The user prepares the tip for receiving the ice cleat by moving the finger out of its recess by pressing the knob with hand or foot in a direction to move the finger out of the tip recess to lower the finger below the contacting surface. With the finger lowered, the ice cleat tube is then slid onto the finger until it contacts the bend of the finger. The user then moves the finger with attached ice cleat tube into the finger recess by reversing the direction of the knob using hand force.

An optional method of moving the finger and ice cleat tube into the recess would be to place the ice cleat teeth against the walking surface and push down on the walking aid, forcing the ice cleat tube into the finger recess and placing the disk against the contact surface of the retrieving tip. The ice cleat is now properly installed. Removal of the ice cleat would require lowering the finger as previously mentioned, removing the ice cleat and returning the finger to the recess. A retrieving tip may have multiple extensions of the finger in the plane of the parallel to the plane of the contact surface beyond the perimeter of the tip. Those extensions may also be used to move the finger out or into the finger recess by foot.

An optional ice cleat shown in FIG. 7 is designed to be placed onto a lowered finger of a retrieving tip without sliding.

What is claimed is:

1. An ice cleat for use on a retrieving tip for a cane, crutch or walking stick, wherein:

the retrieving tip comprises:

a body with a contacting surface having a finger recess therein, a finger with a horizontal portion at a lower end of the finger, the horizontal portion receivable in the finger recess, and a knob at an upper end of the finger, wherein the finger can be moved out of the recess by lowering the knob with respect to the body and returned into the recess by raising the knob with respect to the body;

the ice cleat comprising: a tube, disk and teeth, said tube having a predetermined dimension and shape to fit slidably over the horizontal portion of the finger, said tube having a length to fit within the finger recess of the body when the horizontal portion of the finger is received in the tube and the finger and cleat are moved into the finger recess, said disk being formed of a predetermined material containing a predetermined number of teeth of predetermined length and arrangement depending from a lower surface of the disk, said disk being formed of a non-corrosive metal stamped and formed as a unit, said disk secured to said tube by predetermined means.

* * * * *